US007281549B2

(12) United States Patent
Metzger

(10) Patent No.: US 7,281,549 B2
(45) Date of Patent: Oct. 16, 2007

(54) LOW FRICTION FABRIC

(75) Inventor: Michael B. Metzger, Towson, MD (US)

(73) Assignee: Data Trace Publishing Company, Towson, MD (US)

( * ) Notice: Subject to any disclaimer, the term of this patent is extended or adjusted under 35 U.S.C. 154(b) by 952 days.

(21) Appl. No.: 10/001,764

(22) Filed: Oct. 31, 2001

(65) Prior Publication Data

US 2003/0168118 A1 Sep. 11, 2003

(51) Int. Cl.
*D03D 23/00* (2006.01)
B32B 5/26

(52) U.S. Cl. ..... 139/407; 139/411; 139/419; 139/420 R; 442/239; 442/255

(58) Field of Classification Search ..... 139/407, 139/408, 409, 910, 411, 419, 420 R, 420 A; 442/239, 243, 244, 246, 255
See application file for complete search history.

(56) References Cited

U.S. PATENT DOCUMENTS

| | | | | | |
|---|---|---|---|---|---|
| 4,615,188 | A | * | 10/1986 | Hursh et al. | 66/196 |
| 4,843,844 | A | * | 7/1989 | Hursh et al. | 66/196 |
| 5,586,398 | A | * | 12/1996 | Carlson | 36/114 |
| 5,615,418 | A | * | 4/1997 | Pruit | 2/239 |
| 5,918,317 | A | * | 7/1999 | Bernhardt | 2/239 |
| 6,061,829 | A | * | 5/2000 | Gunn | 2/69 |
| 6,108,820 | A | * | 8/2000 | Bernhardt | 2/239 |
| 6,143,368 | A | * | 11/2000 | Gunn | 427/407.1 |

* cited by examiner

*Primary Examiner*—Gary L. Welch
*Assistant Examiner*—Robert H. Muromoto, Jr.
(74) *Attorney, Agent, or Firm*—John S. Hale; Gipple & Hale

(57) ABSTRACT

A low friction fabric constructed of a first layer of woven polyester fibers with an upper and lower woven surface attached to and adjacent a second layer of the same weave of polyester fibers, the second layer having an upper and lower surface. Each of the woven layers comprising a straight yarn in the warp of the weave pattern with the weaves of the layers being oriented at a 90 degree angle to one another.

14 Claims, 5 Drawing Sheets

LOW FRICTION FABRIC

FIELD OF THE INVENTION

This invention relates to a fabric designed to minimize shear forces. It has both medical and recreational applications.

BACKGROUND OF THE INVENTION

The formation of calluses is primarily a result of friction. As the layers of skin are loaded in a shearing fashion, the planes of skin separate. This leads to blistering in the space between layers. With further progression of shear loads, the upper layer or layers of skin can be traumatized to the point where it separates from the deeper layers. This results in painful, raw, exposed dermis. In addition to the pain associated with exposure to these deeper layers, there is a danger of progression of the sore as successive layers are forcefully torn away. Ultimately, this can lead to open sores called ulcers. Ulcers occur when the depth of the wound has advanced through the epidermis, dermis, and into the subcutaneous fat layer. This layer is highly vascular, and susceptible to infection.

Separation of layers of skin that led to this destructive process is a result of mechanical forces. In particular, the skin structure can be traumatized by vertical forces, perpendicular to the skin, or by shear forces, in the same plane as the skin, with shear forces being the primary culprit. It is these excessive shear forces that are the primary mechanical cause of various skin pathologies and a contributing factor to the failure of medical treatment modalities such as skin grafts. For many people excessive shear force is the primary cause of blistering during day-to-day activities and during high impact activities that occur in many sports. An interface that is capable of reducing or eliminating shear forces would greatly reduce the potential for formation of blisters, and reduce the risk of subsequent ulcers and infection. This is particularly a problem in many medical conditions where the patient has reduced sensitivity as a result of disease or medical procedure. These patients may be unaware of the formation of such skin lesions or ulcers until they are quite advanced. In fact, the leading cause of non-traumatic amputation of a leg or foot is infection following ulcer formation in diabetic patients with neuropathy. In the US alone, nearly 60,000 amputations are performed annually due to non-healing ulcers, with an annual cost in excess of $2 billion.

In the medical field, attempts to reduce the shear force have utilized various polymers in the form of dimensional foams or gels. The idea was to have the material compress and rotate so that the shearing forces were taken up within the material and not at the material skin interface.

The problem with this type of apparatus is not only that the amount of reduction in the shear dependent on the property of the material, but it is also dependent on the thickness of the material. The thicker the material, the greater the reduction in shear forces. To provide adequate amounts of shearing between surfaces of the material there must be a nominal dimensional thickness to the foam or gel. As the material gets thinner less motion between surface layers occurs, thereby limiting its usefulness in reducing shear forces. So the limitations of the dimensional polymers to reduce friction is dependent on their thickness and their unique chemical make up. How much side to side motion the top and bottom layers can move is dependent on how far each polymer can give or slide before the combined force overcomes the shear force. When this occurs the skin will slide on top of the foam producing greater shear forces or the polymers will break. This break down is an additional problem with dimensional polymers. Under prolonged shearing force the material eventually fatigues and fails. This results in material compression or more commonly cracks and tears.

Likewise, with athletic equipment, such as socks, the problem of blistering after extended periods of activity is well known. When an athlete endures high physical stress, the magnitude and frequency of the skin rubbing against the inner surface of a sock or other high-impact area, is increased when compared to normal daily activity. Thus, the blistering caused by such shearing forces is a common ailment of many athletes. The ability of a sock to prevent this blistering has been heretofore limited to different materials and weaves, principally for the purpose of providing cushioning. Providing a sock with reduced shear forces is unknown. The same is true of gloves, points of contact with various padding, and other athletic equipment.

SUMMARY OF THE INVENTION

Figure 1:
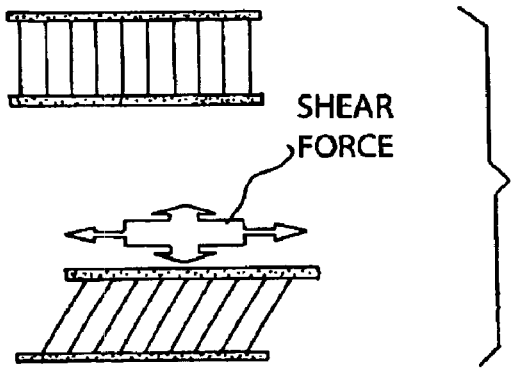
FIG. 1 is an exploded schematic showing the top of the material with shear force applied thereto with the bottom surface fixed.
Figure 2:
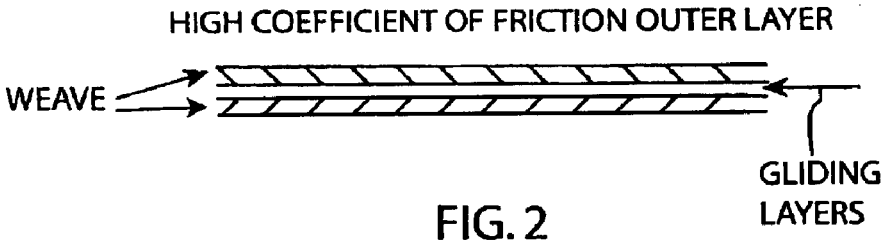
FIG. 2 is a cross sectional view the fabric of the present invention with the layers placed in orthogonal relationship.
Figure 3:
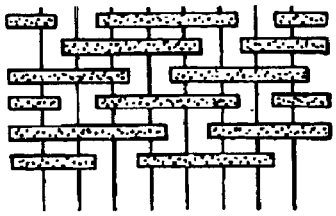
FIG. 3 is an enlarged planar schematic view of the fabric of the present invention showing an over four under one pattern weave.

The present invention uses a novel approach to solve the problem by allowing multiple layers to move or glide on the inner layers. By doing so, the present invention is not dependent on the thickness of the material or the chemical property of the polymer to allow for the motion to be taken up within the material. This means it is possible to produce a device that is much thinner and can reduce greater amounts of shear force.

The properly oriented fabric found in the present invention is designed to greatly reduce these shear forces. In tests, the coefficient of friction is so low that the shear forces are virtually eliminated. Thus, the potential for blister formation and ulcer formation is greatly reduced. The reduced-friction fabric system can be placed in strategic positions within a shoe or sock to reduce the risk of blister formation. In the shoe, the regions, which are most likely to develop blisters and calluses are around the heel, across the ball of the foot, and over the tips and tops of the toes.

Although this is an important breakthrough for all athletic individuals, or those that do a great deal of walking and running, the population which is most likely to benefit from this breakthrough are those with neuropathy. Peripheral sensory neuropathy reduces a person's ability to feel their feet. Consequently, they are not aware when a blister forms, or progresses to the point of ulceration, until blood is observed in a sock or on the floor. These individuals do not have the ability to detect when their skin has been injured. As a result, they continue to carry on with their normal activities until the breakdown of skin is so severe that they are at risk for deep infections.

Reduced friction cloth would greatly reduce the risk of ulcers in people with a peripheral neuropathy from diseases like diabetes. More importantly, it would help in the healing process by controlling the pathologic mechanical forces causing ulcers, and diminishing the injury to newly forming skin, which is extremely fragile. Once an ulcer is closed, it would help the area to remain closed, by controlling these dangerous shear forces.

Reduced friction cloth could also be utilized in quadriplegic and hemiplegic patients who are at risk for pressure sores due to prolonged sitting while possessing a neuropathy. These patients must be continually repositioning themselves to avoid prolonged pressure in one area. Often times when they reposition themselves their garments become entangled thereby unknowingly increasing the pressure. Reduced friction cloth could be produced or applied into their garments decreasing the occurence of this.

Additionally, the present invention would have a tremendous impact on wound dressing devices. Plastic surgeons and those treating burns and ulcers require frictionless bandaging systems to reduce the level of mechanical stress on the superficial skin structures. Standard dressings, which adhere to a wound, can easily disrupt new skin grafts or cause deeper injuries to slowly healing wounds by shearing the layers of skin. A frictionless system would allow the patient greater mobility by allowing movement, even adjacent to bony prominences and joints The invention also has considerable application in the athletic field. Socks made of this material would greatly reduce blistering on the foot when engaged in the high stress conditions athletes often endure. Blistering on the foot is common when running. The cause is friction when the foot slides against the inner surface of the sock. A sock with its sole coated with the present invention would prevent or minimize such friction as the two layers of the present invention would move across each other instead of the foot sliding across the inner surface of the sock.

Some other applications of the invention include, but are not limited to:

In the area of medicine, the product could be used in making:

Bandages and/or pads applied to areas of the body to help avoid friction.

Socks for diabetics or related podiatric ailments.

Bed coverings (sheets) for bedridden patients.

In the area of recreation, the product could be used in making:

Pads that protect shoulders, elbows, knees and other body parts.

Innersole of a shoe or as an insert that can be added to a shoe.

Bicycle seat or a covering for an existing bicycle seat.

Car seats or travel cushions.

DETAILED DESCRIPTION OF PREFERRED EMBODIMENT

The present invention provides these advantages by placing two fabric layers at an angle to each other to create a reduced friction cloth. A woven fabric is composed of two yarns, interlocking from two directions. As you look at a piece of cloth, the fibers that are running the length of the cloth are known as the warp yarns and the fibers running perpendicular to these are known as the weft yarns. The long sides of the fabric are the selvage ends. These finished ends are made by the weft yarns turning around to weave back through the warp.

There are different patterns to weaving and different combinations of yarn types to make a specific fabric. An oxford shirt for example uses the over, under, over, under etc. pattern for the weft yarns, with the warp and weft yarns of the same material. If this weave were examined closely it would appear the same in from all directions.

The reduced friction cloth uses a different weave and two different types of yarn to achieve its smooth side and its rough side. The material used is comprised of two polyester fibers, though other material compositions would be suitable and substitution of other materials is obvious to those skilled in the art. The warp being a very straight yarn and the weft yarn being a low twist yarn. The weft travels over four and under one in the weaving pattern, though again, different weaves are possible and the use of other weaves would be obvious to those skilled in the art. This weave allows for much more surface area of the filling yarn to be exposed. The orientation of this surface is what produces the different properties. When the material is placed back upon itself or aligned so the weft fibers are parallel to each other the material has a high coefficient of friction. When the fibers are placed orthogonal to each other the coefficient of friction is much lower.

Two layers of such a weave fabric are combined to produce the reduced friction cloth. By adjusting the angle at which the layers are related, an increase or decrease of the friction between the layers can be achieved. Tests indicate that a maximum friction is achieved when the weaves are oriented in parallel, and a minimum friction is achieved when the weaves are orthogonal.

TEST RESULTS

EXAMPLE I

Figure 4:
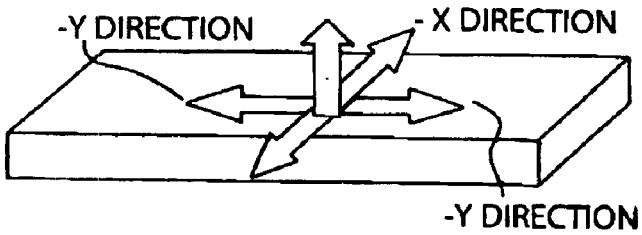
FIG. 4 is a schematic representation of the shear forces applied in an X side by side and Y front to back relationship with respect to the force collection plate on which testing was undertaken.
Figure 5:
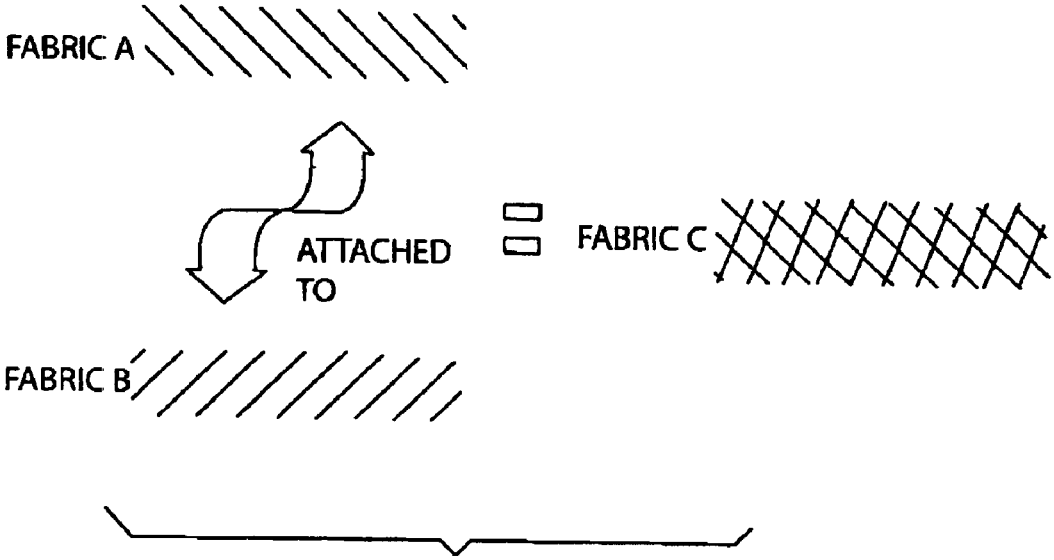
FIG. 5 is an exploded representation of the two layers of fabric with the weave oriented and attached to form the low friction fabric.

The cloth was placed between the heel and a Bertec force plate sampling at 120 Hz. The two components of the shear force is separated into an ±X medial to lateral (side to side) and an ±Y anterior posterior (front to back) component with respect to the force collection plate. The positive and negative values only indicate direction of the force with respect to the center of the plate (as seen in FIG. 4).

EXAMPLE II

Using a TMI (Testing Machines Inc.) Model 32-06 Slip Friction Tester was calibrated and was running in an environment of 72 degrees Fahrenheit at 40% humidity. The following test was performed:

An 8.5-cm by 33-cm sample of the fiber was fixated to the bed of the test unit. A 6.5-cm by 6.5-cm sample of the fiber was then fixated to the sled of the test unit with the fibers oriented in the same direction as the fibers on the test bed of the unit. This was designated as a 0 (zero) degree orientation. A test for static and dynamic coefficient of friction was then performed according to the ASTM D 1894 protocol. The static measurement is a reflection of the larger frictional forces during the initiation of motion while the kinetic measurement reflects the friction occurring once the sled was already moving. Thirty tests were performed using the same samples for each test.

The original sample on the sled was then replaced with a sample of the same fiber type with the direction of the fibers oriented at 30, 45, 60, and 90 degrees to the sample on the bed of the machine. This was designated as a 30, 45, 60 and 90-degree orientation respectively. Using the same test as described above, 115 additional tests were performed. Below are the statistical results.

| Static | 0 degrees | 30 degrees | 45 degrees | 60 degrees | 90 degrees |
|---|---|---|---|---|---|
| N | 30 | 20 | 25 | 30 | 30 |
| Average | 0.3971 | 0.259 | 0.2353 | 0.217 | 0.2097 |
| St dev | 0.0082 | 0.0082 | 0.0136 | 0.0081 | 0.0106 |
| Min | 0.382 | 0.245 | 0.213 | 0.202 | 0.192 |
| Max | 0.425 | 0.28 | 0.263 | 0.231 | 0.233 |
| Kinetic | 0 degrees | 30 degrees | 45 degrees | 60 degrees | 90 degrees |
| N | 30 | 30 | 25 | 30 | 30 |
| Average | 0.3729 | 0.235 | 0.2096 | 0.193 | 0.1849 |
| St dev | 0.009 | 0.0063 | 0.0116 | 0.0036 | 0.007 |
| Min | 0.351 | 0.222 | 0.191 | 0.186 | 0.176 |
| Max | 0.396 | 0.25 | 0.236 | 0.199 | 0.207 |
| % difference | Static | Kinetic | | | |
| 0 vs 30 | −36.93 | −34.73 | | | |
| 0 vs 45 | −40.74 | −43.8 | | | |
| 0 vs 60 | −45.35 | −48.25 | | | |
| 0 vs 90 | −47.19 | −50.42 | | | |

EXAMPLE II

This represents a 50% reduction in the friction.

Figure 6:
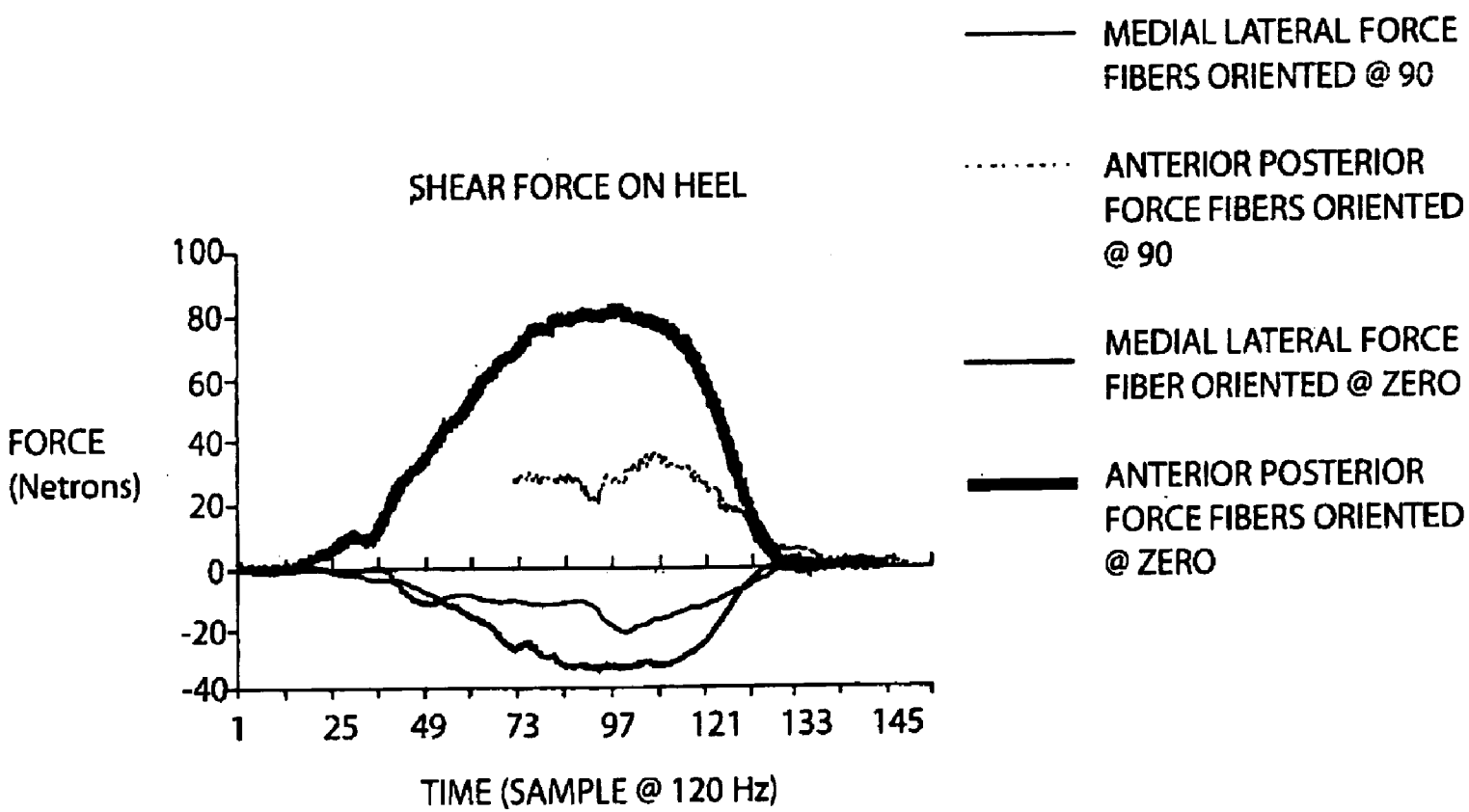
FIG. 6 is a graph showing shear reactive force applied across the heel for a period of time with the same fiber under two different alignments.
Figure 7:
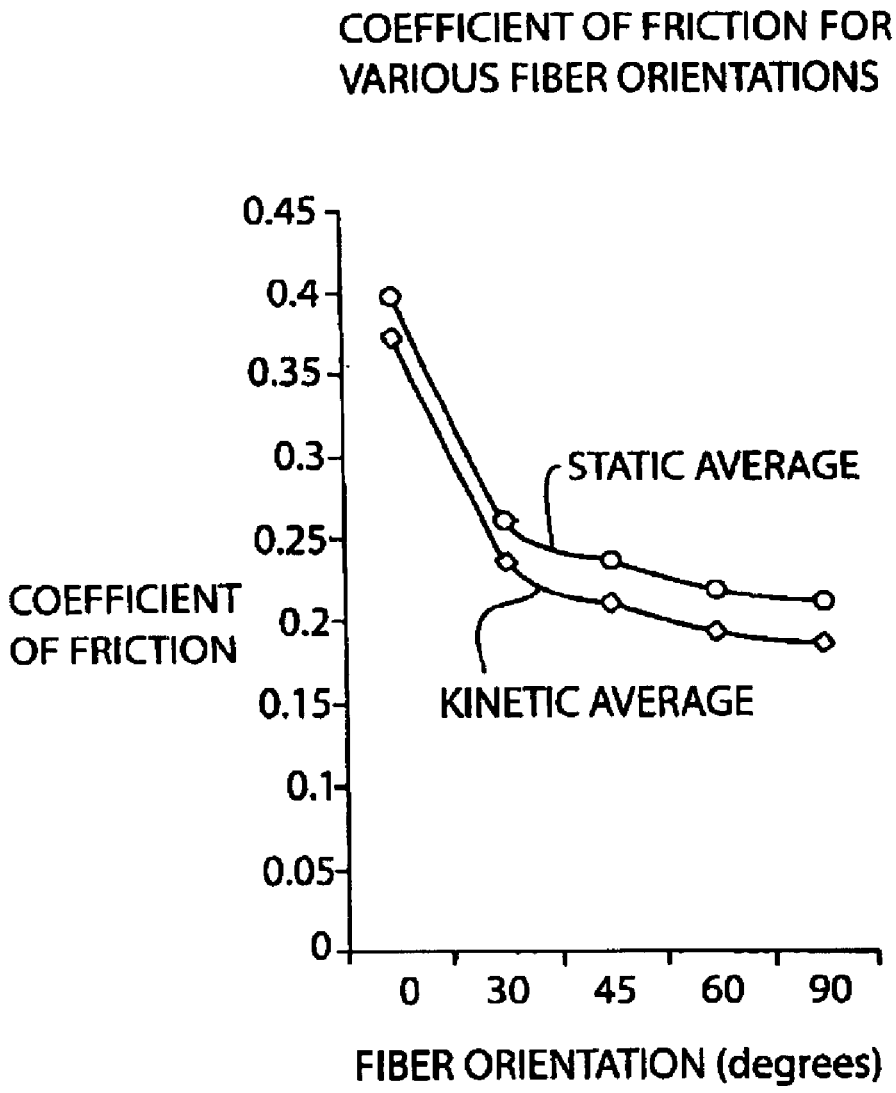
FIG. 7 is a graph showing coefficient of friction for various fiber orientations.
Figure 8:
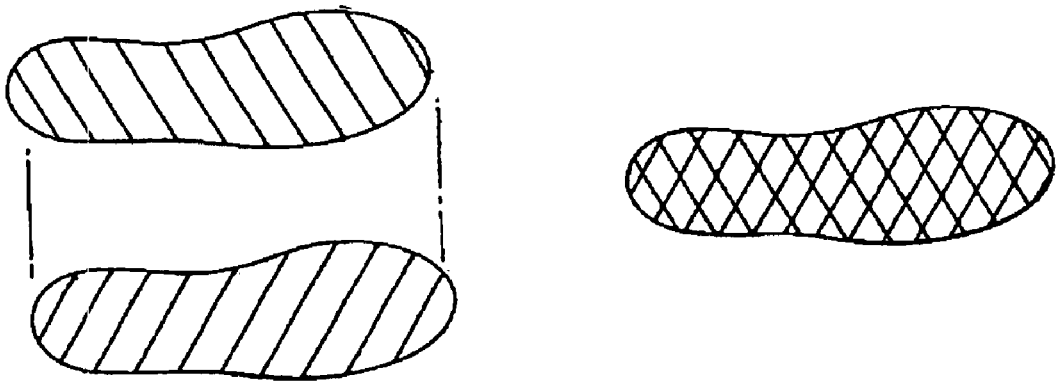
FIG. 8 is both an exploded and top plan view of a shoe insert or insole and an exploded bottom plan view of a sock.
Figure 9:
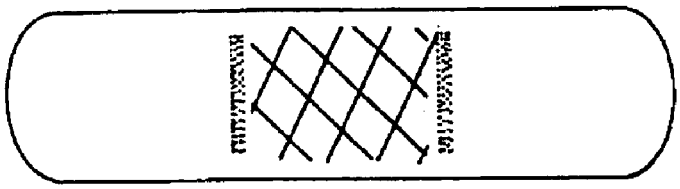
FIG. 9 is a bottom plan view of a bandage using the low friction fabric of the present invention.

The graph of FIG. 6 shows the shear reactive force being applied across the heel for a period of time with the same fiber render two different alignments. Fibers oriented at zero are aligned while those indicated at 90 are orthogonal to each other.

What is claimed is:

1. A low friction fabric comprising a first layer of woven material with an upper and lower woven surface attached comprising at least two different types of yarn to a second layer of woven material of the same weave, said second layer having an upper and lower woven surface comprising at least two different types of yarn, said fabric layers being in contact with said lower surface of said first layer having a weave of a first orientation contacting the entire said upper surface of said second layer, said second layer having a weave with a second orientation orthogonal to the orientation of the weave of said first layer to reduce the coefficient of friction between the layers.

2. The low friction fabric of claim 1 wherein said fabric is constructed as a sock.

3. A low friction fabric using two different types of yarn to achieve a smooth side and a rough side comprising a first layer of woven polyester fibers with an upper and lower woven surface attached to and adjacent a second layer of the same weave of woven polyester fibers said second layer having an upper and lower surface, each of said woven layers comprising a weave with a straight yarn in the warp of the weave pattern and a low twist yarn in the weft of the weave pattern, said lower surface of said first layer being in contact with the said upper surface of said second layer with the weft yarn of said layers oriented at a 90 degree angle to one another.

4. The low friction fabric of claim 3 wherein said fabric is constructed as a sock.

5. The low friction fabric of claim 1 wherein said fabric is a bandage.

6. The low friction fabric of claim 3 wherein said fabric is a bandage.

7. The low friction fabric of claim 1 wherein said fabric is constructed as a shoe insert.

8. The low friction fabric of claim 3 wherein said fabric is constructed as a shoe insert.

9. A low friction fabric as claimed in claim 3 wherein said woven fabric is an over four under one weave.

10. A low friction fabric as claimed in claim 1 wherein said woven fabric is an over four under one weave.

11. A low friction fabric comprising a first layer of woven polyester fibers having an over four under one weave with an upper and lower surface, each of said layers comprising a straight yarn in the warp of the weave pattern and a low twist yarn in the weft of the weave pattern, said lower surface of said first layer being in contact with said upper surface of said second layer with the weft yarn of said layers being oriented at a 90 degree angle to each another.

12. The low friction fabric of claim 11 wherein the fabric is constructed as a sock.

13. The low friction fabric of claim 11 wherein said fabric is as a bandage.

14. A low friction fabric comprising a first layer of woven material with an upper and lower woven surface attached to a second layer of woven material of the same weave, said second layer having an upper and lower woven surface, said fabric layers being in contact with said lower surface of said first layer having a weave of a first orientation contacting the entire said upper surface of said second layer, said second layer having a weave with a second orientation orthogonal to the weave of said first layer to reduce the coefficient of friction between the layers, said fabric is constructed as a shoe insert.

* * * * *